US008121502B2

(12) United States Patent
Yamagata

(10) Patent No.: US 8,121,502 B2
(45) Date of Patent: Feb. 21, 2012

(54) FIXING UNIT INCLUDING HEATING REGULATOR TO ADJUST A HEATING WIDTH OF A HEATING MEMBER

(75) Inventor: Masanobu Yamagata, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 300 days.

(21) Appl. No.: 12/385,199

(22) Filed: Apr. 1, 2009

(65) Prior Publication Data

US 2009/0252519 A1 Oct. 8, 2009

(30) Foreign Application Priority Data

Apr. 3, 2008 (JP) ..... 2008-097368

(51) Int. Cl.
*G03G 15/20* (2006.01)

(52) U.S. Cl. ..... 399/45; 399/68; 399/328; 399/334

(58) Field of Classification Search ..... 399/45, 399/68, 67, 328, 329, 330, 334
See application file for complete search history.

(56) References Cited

U.S. PATENT DOCUMENTS

| | | | | |
|---|---|---|---|---|
| 6,115,563 | A | 9/2000 | Miyamoto | 399/67 |
| 7,437,113 | B2 * | 10/2008 | Suzuki et al. | 399/328 |
| 7,653,320 | B2 * | 1/2010 | Ota et al. | 399/45 |
| 2006/0029411 | A1 * | 2/2006 | Ishii et al. | 399/67 |
| 2006/0104652 | A1 * | 5/2006 | Nishiyama | 399/68 |
| 2011/0176822 | A1 | 7/2011 | Ishii et al. | 399/45 |

FOREIGN PATENT DOCUMENTS

| | | |
|---|---|---|
| EP | 1 621 940 | 2/2006 |
| JP | 07-191571 | 7/1995 |
| JP | 2000-098794 | 4/2000 |
| JP | 2001-209291 | 8/2001 |
| JP | 2001-255772 | 9/2001 |
| JP | 2003-076171 | 3/2003 |
| JP | 2003-173103 | 6/2003 |
| JP | 2004-117626 | 4/2004 |
| JP | 2004-198898 | 7/2004 |
| JP | 2005-266505 | 9/2005 |
| JP | 2005-345531 | 12/2005 |
| JP | 2006-010886 | 1/2006 |
| JP | 2006-011033 | 1/2006 |
| JP | 2006-154061 | 6/2006 |
| JP | 09-080968 | 3/2007 |
| JP | 2007-078790 | 3/2007 |
| JP | 2007-155786 | 6/2007 |

OTHER PUBLICATIONS

Search report dated Dec. 6, 2011, in corresponding European Patent Application No. 09250843.1.

* cited by examiner

*Primary Examiner* — Sophia S Chen
(74) *Attorney, Agent, or Firm* — Harness, Dickey & Pierce, PLC

(57) ABSTRACT

An image forming apparatus for forming an image includes a first control table and a second control table. The first control table includes information on widths of a recording sheet, categorized into a plurality of groups of different widths thereof in a direction perpendicular to a sheet transport direction. The second control table includes information on timing of the recording sheet transported to the fixing device based on the group to which a preceding recording sheet, belongs and the group to which a subsequent recording sheet belongs. When a certain width of the recording sheet belongs to the plurality of the groups in the first control table, the group to which the preceding recording sheet belongs is the group to which the subsequent recording sheet belongs.

5 Claims, 7 Drawing Sheets

| GROUP B OF PRECEDING RECORDING MEDIUM (G1) / GROUP B OF NEXT RECORDING MEDIUM (G2) | 2 | 1 |
|---|---|---|
| 2 | 0.2 | 4 |
| 1 | 4 | 0.2 |

FIG. 7

| WIDTH (GROUP B) | G = 2 (200 mm or more) | | | G = 1 (less than 200 mm) | | | |
|---|---|---|---|---|---|---|---|
| WIDTH (GROUP A) | 297 | 257 | 210 | 182 | 148 | 128 | 105 |
| LOWER LIMIT | 275 or more | 247 or more | 200 or more | 172 or more | 138 or more | 118 or more | |
| UPPER LIMIT | - | less than 275 | less than 247 | less than 200 | less than 172 | less than 138 | less than 118 |
| PORTRAIT MODE | A3 | B4 | A4 | B5 | A5 | B6 | A6 |
| LANDSCAPE MODE | A4 | B5 | A5 | B6 | A6 | - | - |

FIG. 8

| TYPE OF RECORDING MEDIUM \ SHEET WIDTH | G1>G2 | G1<G2 | G1=G2 |
|---|---|---|---|
| NORMAL → THICK | 6 | 7 | 4 |
| THICK → NORMAL | 0.2 | 4 | 0.2 |
| NORMAL → NORMAL | 0.2 | 4 | 0.2 |
| THICK → THICK | 0.2 | 4 | 0.2 |

FIG. 10

| GROUP B OF PRECEDING RECORDING MEDIUM (G1) / GROUP B OF NEXT RECORDING MEDIUM (G2) | 2 | 1 |
|---|---|---|
| 2 | 0.2 | 4 |
| 1 | 0.2 | 0.2 |

FIG. 11

| WIDTH (GROUP B) | G = 2 (200 mm or more) | | G = 1 (less than 200 mm) | | | | |
|---|---|---|---|---|---|---|---|
| WIDTH (GROUP A) | 297 | 257 | 210 | 182 | 148 | 128 | 105 |
| LOWER LIMIT | 275 or more | 247 or more | 200 or more | 172 or more | 138 or more | 118 or more | |
| UPPER LIMIT | – | less than 275 | less than 247 | less than 200 | less than 172 | less than 138 | less than 118 |
| PORTRAIT MODE | A3 | B4 | A4 | B5 | A5 | B6 | A6 |
| LANDSCAPE MODE | A4 | B5 | A5 | B6 | A6 | – | – |

FIXING UNIT INCLUDING HEATING REGULATOR TO ADJUST A HEATING WIDTH OF A HEATING MEMBER

CROSS-REFERENCE TO RELATED APPLICATIONS

This patent application is based on and claims priority pursuant to 35 U.S.C. §119 from Japanese Patent Application No. 2008-097368 filed on Apr. 3, 2008 in the Japan Patent Office, the entire contents of which are hereby incorporated herein by reference.

BACKGROUND OF THE INVENTION

1. Field of the Invention

Exemplary aspects of the present invention generally relate to an image forming apparatus, such as a copier, a facsimile machine, a printer, or a multi-functional system including a combination of at least two of these functions.

2. Description of the Background Art

Conventionally, a generally known image forming apparatus, such as a copier, a facsimile machine, a printer, or a multi-functional system including a combination of at least two of these functions, can form an image on a sheet serving as a printable recording medium in various sizes, for example, A4, A3, A5, B4, and so forth. To do so, the image forming apparatus employs a fixing unit to fix the image on the sheet with heat and pressure. The fixing unit, which extends across the entire width of that recording medium which has the widest width that the image forming apparatus can accommodate, includes a heating member, a fixing member, and an auxiliary fixing member.

With different sizes of the recording sheet, such as A4 size and A5 size, which are not as wide as the A3 size (297 mm) sheets having the widest width that the image forming apparatus can accommodate and therefore do not extend across the entire width of the fixing unit, when the fixing unit fixes the image onto the A4 size or A5 size sheet, temperatures of the fixing unit at or near lateral end portions of the heating member, the fixing member, and the auxiliary fixing member over which the A4 size and A5 size recording media do not extend rise significantly, resulting in problems such as uneven fixation of the image, deterioration of the fixing member, and so forth, ultimately causing damage to the fixing unit.

In particular, in order to reduce a rise time of the image forming apparatus, that is, the time required for the image forming apparatus to start printing after power is turned on, a high-power heating member and a relatively thin-film fixing member have come to be required. However, a drawback to this configuration is that temperatures at the end portions of the heating member, the fixing member, and so forth rise significantly.

To address the above-described problems, one related-art fixing unit includes a regulator (hereinafter "regulator") that changes how much of the fixing member is heated along its width (hereinafter also referred to as the heat width of the fixing member) depending on the width of the recording sheet being printed. This fixing unit employs an induction heating method using electromagnetic induction. In the induction heating method, a coil generates a magnetic field serving as a heat source.

The regulator consists of a heating portion and a regulating portion. Ferrite is used in the heating portion and copper used in the regulating portion of the regulator, thereby producing a difference in heating efficiency and thus regulating the heat width of the heating member.

Furthermore, the regulator rotates in association with the recording sheet so as to adjust the heat width of the heating member, thus changing the heat width of the fixing member to match the width of the recording sheet. As a result, a significant rise in temperatures at the end portions of the heating member, the fixing member, and so forth can be prevented.

However, there is a drawback to this configuration when printing is performed continuously on recording sheets of various sizes (for example, A4, A3, A5, B4) and different kinds (for example, an envelope, a paper sheet, etc.).

For example, when printing is performed alternately on an envelope and a different kind of a printable medium from the envelope such as a sheet of paper, or when printing is performed alternately in vertical and horizontal directions on a plurality of recording sheets of the same size fed from a plurality of sheet feeders (generally known as "rotary sorting"), printing is continuously performed on the recording sheets of different widths.

In order to continuously print an image on the recording sheets of different sizes having different widths, in other words, when the image forming apparatus that can accommodate an A3-size recording sheet continuously performs printing on the A3 recording sheet, then the A5 recording sheet, and then the A4 recording sheet sequentially, in that order, without changing the heat width of the fixing unit for each recording sheet for the sake of maintaining a certain print speed throughout the printing, either a significant rise in temperatures or insufficient heat at the end portions of the heating member, the fixing member, and so forth, occurs.

In this regard, the heat width needs to be changed for every sheet, necessitating extra time for changing the heat width. Consequently, after the first sheet is fed, a certain amount of time needs to be provided before the second sheet is fed, thereby reducing printing speed for continuous printing.

In view of the above, various approaches have been proposed in an attempt to solve the problem described above.

For example, in one conventional heating member, in order to prevent temperature rises in areas where the recording sheet does not contact the fixing member, a driving speed is switched from a normal speed to a low-speed mode only when a relatively small-size recording sheet is specifically designated for printing by the image forming apparatus, or, if the apparatus is part of a network, by a host computer (server) that controls printing. By contrast, when there is no designation of the small-size recording sheet, the driving speed is set at a normal speed.

Thus, even when a detector detects an actual recording sheet being a small size after the device starts to be driven at the normal speed, the driving speed is still not switched to the low-speed mode for the small sized paper, and throughput control is performed corresponding to the small sized recording sheet at the normal speed.

With this configuration, no detector for detecting the size of the recording sheet is necessitated at an opening from which the recording sheet is fed, thereby providing an inexpensive configuration that still allows the low-speed mode to be set easily. Furthermore, under any conditions, the fixing device does not fail due to temperature rises where the recording sheet is not present.

However, there is also a drawback to the foregoing approach in that when the small-sized recording sheet is designated by the user, switching the driving speed to the low-speed mode, the printing speed for continuous printing is forced to slow down.

Furthermore, when switching the driving speed from the normal-speed mode to the low-speed mode, extra time is required for switching the mode, thereby also slowing down the printing speed for continuous printing.

In another related-art approach to prevent reduction of the printing speed for the first page to be printed, both a relatively large heater as well as a small heater are provided in the image forming apparatus and heating is switched between the two according to paper size. In the image forming apparatus of this approach, when fixing the first sheet after printing is initiated, a CPU for controlling operation of the image forming apparatus always supplies power to the large heater regardless of the paper size.

After the small-sized recording sheet is fixed, the large heater is turned on. Furthermore, after the small-sized recording sheet is fixed, the CPU not only turns on the large heater, but also measures the temperature of the heater and stops transport of the recording sheet when the temperature of the heater does not reach a predetermined temperature. Fixing is resumed when the temperature of the heater reaches the predetermined temperature.

A drawback to the foregoing configuration is that, because the large heater is turned on before the first printing and after the small-sized recording sheet is printed, a significant rise in temperatures occurs at the end portions of the fixing member, the auxiliary fixing member, the heat source, and so forth. Moreover, when printing is alternately performed between the large-sized paper and the small-sized paper, problems such as uneven fixation and deterioration of the fixing member occur.

Furthermore, according to the foregoing technology, two heaters, both the large-sized heater and the small-sized heater, are necessitated, thereby increasing the cost of the image forming apparatus as a whole. In addition, generally, in order to maintain imaging quality, the fixing unit is periodically replaced, causing the cost per paper to increase despite the effort of improving the printing speed for continuous printing.

In order to overcome such problems, when printing out a plurality of the recording sheets, the recording sheets are divided into different groups by width, and the group to which the preceding recording sheet belongs is compared with the group to which the subsequent recording sheet belongs.

Only when the amount of heat generated in the vicinity of the end portions of the fixing member, the auxiliary fixing member, the heat source, and so forth is not sufficient, a relatively long interval is provided before subsequent transport of transfer paper is started. Other than that, continuous printing is performed at predetermined intervals. Accordingly, a certain printing speed can be maintained when continuously printing, while a significant rise in temperatures and/or insufficient heating can be prevented.

However, there is also a drawback to this approach. Since the recording sheet in the preceding group and the recording sheet in the subsequent group are compared with each other, and the relatively long interval is provided before the subsequent transport of the recording sheet is started, the timing with which the recording sheet is transported varies in each case, thus decreasing overall printing speed.

SUMMARY OF THE INVENTION

In view of the foregoing, in one illustrative embodiment of the present invention, an image forming apparatus for forming an image includes an image bearing member, a developing device, a transfer device, a fixing device, a sheet feeder, a first control table, and a second control table. The image bearing member is configured to bear an electrostatic latent image on a surface thereof. The developing device is configured to develop the electrostatic latent image formed on the image bearing member using toner to form a toner image. The transfer device is configured to transfer the toner image onto a recording sheet. The fixing device is configured to fix the toner image. The sheet feeder is configured to feed the recording sheet. The first control table includes information on widths of the recording sheet categorized into a plurality of groups of different widths thereof in a direction perpendicular to a sheet transport direction. The second control table includes information on timing of the recording sheet transported to the fixing device based on the group to which a preceding recording sheet belongs and the group to which a subsequent recording sheet belongs. When a certain width of the recording sheet belongs to the plurality of the groups in the first control table, the group to which the preceding recording sheet belongs is the group to which the subsequent recording sheet belongs.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein:

FIG. 7 is an example of a table for showing classification of a width of a recording sheet according to another illustrative embodiment of the present embodiment;

FIG. 8 is an example of a second control table according to another illustrative embodiment of the present invention;

FIG. 10 is an example of a second control table according to another illustrative embodiment of the present invention; and FIG. 11 is an example of a first control table according to another illustrative embodiment of the present invention.

DETAILED DESCRIPTION OF ILLUSTRATIVE EMBODIMENTS

Figure 1:
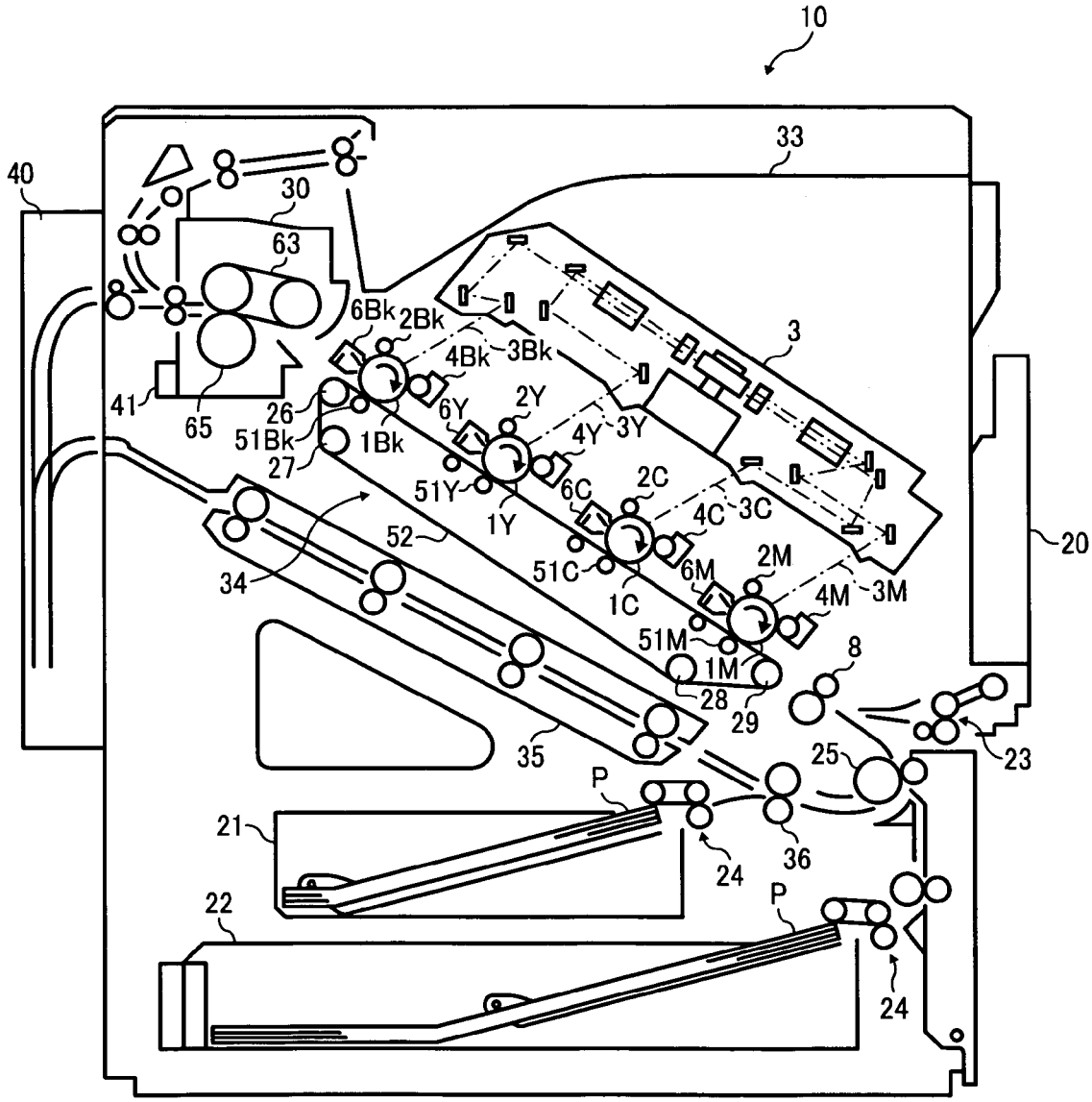
FIG. 1 is a schematic diagram illustrating a color printer as an example of an image forming apparatus according to an illustrative embodiment of the present invention.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and alternative example, for the sake of simplicity of drawings and descriptions, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus according to an illustrative embodiment of the present invention is described.

Referring now to FIG. 1, there is provided a schematic diagram illustrating a color printer of a tandem direct-transfer type as one example of the image forming apparatus 10.

As illustrated in FIG. 1, the image forming apparatus 10 includes three sheet feed trays for supplying recording media P including a manual sheet feed tray 20, sheet cassettes 21 and 22, a sheet feeder 23, a pair of registration rollers 8, a separation member 24, a pair of transport rollers 25, a transfer belt 52, transfer rollers 51M, 51C, 51Y, and 51Bk, and so forth.

The image forming apparatus 10 includes image forming stations for colors of black (Bk), yellow (Y), cyan (C), and magenta (M). The image forming stations for black, yellow, cyan, and magenta all have the same configuration, differing only in the color of toner employed. Thus, the description is thereafter provided of the image forming station for the color black as a representative example of the image forming stations.

It is to be noted that reference characters Bk, Y, C, and M denote the colors black, yellow, cyan, and magenta, respectively.

The image forming station for black includes the photoreceptor drum 1Bk, a charging roller 2Bk for charging the photoreceptor drum 1Bk, a developing device 4Bk, and a cleaning device 6Bk for removing residual toner from the surface of the photoreceptor drum 1Bk. 3Bk denotes an optical axis of a laser beam illuminating the photoreceptor drum 1Bk. An optical writing unit 3 projects the laser beam against the photoreceptor drum 1Bk. The image forming station for yellow includes the photoreceptor drum 1Y, a charging roller 2Y for charging the photoreceptor drum 1Y, a developing device 4Y, and a cleaning device 6Y for removing residual toner from the surface of the photoreceptor drum 1Y. The image forming station for cyan includes the photoreceptor drum 1C, a charging roller 2C for charging the photoreceptor drum 1C, a developing device 4C, and a cleaning device 6C for removing residual toner from the surface of the photoreceptor drum 1C. The image forming station for magenta includes the photoreceptor drum 1M, a charging roller 2M for charging the photoreceptor drum 1M, a developing device 4M, and a cleaning device 6M for removing residual toner from the surface of the photoreceptor drum 1M. 3Y, 3C and 3M denote optical axes of laser beams illuminating the photoreceptor drums 1Y, 1C and 1M, respectively.

When feeding manually, recording media sheets P, not illustrated, serving as printable media, are fed from the manual sheet feed tray 20 one sheet at a time. A top sheet of the recording sheet P is separated from the rest of the sheets one sheet at a time by the sheet feeder 23 and transported to the pair of the registration rollers 8.

The recording sheet P being fed is stopped at the pair of the registration rollers 8 and aligned so that skew is corrected. Subsequently, the recording sheet P is transported to the transfer belt 52 in appropriate timing such that the recording sheet P is aligned with a toner image formed on the photoreceptor drum 1M serving as an image bearing member provided substantially uppermost stream.

A suction roller, not illustrated, contacts the transfer belt 52 forming a nip therebetween. When the recording sheet P passes the nip between the transfer belt 52 and the suction roller, bias is applied to the suction roller so that the recording sheet P is electrostatically suctioned to the transfer belt 52 and transported at a predetermined process linear velocity.

The recording sheet P suctioned to the transfer belt 52 is applied with a transfer bias, that is, a polarity opposite the polarity of toner, by transfer rollers 51M, 51C, 51Y, and 51Bk.

The transfer rollers 51M, 51C, 51Y, and 51Bk are disposed corresponding to the photoreceptor drums 1M, 1C, 1Y, and 1Bk through the transfer belt 52, and serve as transfer bias application members. Accordingly, toner images formed on the photoreceptor drums 1M, 1C, 1Y, and 1Bk in magenta (M), cyan (C), yellow (Y), and black (Bk) are sequentially transferred onto the recording sheet P.

After the toner images are transferred onto the recording sheet P, the recording sheet P separates from the transfer belt 52 at a drive roller 26 due to its curvature and is transported to a fixing unit 30.

In the fixing unit 30, a fixing belt 63 serving as a fixing member, and a pressure roller 65 provided opposite the fixing belt 63 and serving as a pressure member sandwich the recording sheet P therebetween. It is to be noted that the place where the fixing belt 63 and the pressure roller 65 meet and press against each other is a so-called fixing nip portion. In the fixing nip portion, heat and pressure are applied to the toner image so that the toner image is fixed onto the recording sheet P.

In a case of a single-sided printing, after the toner image is fixed on one side of the recording sheet P, the recording sheet P is discharged onto a sheet discharge tray 33 provided substantially at an upper portion of the image forming apparatus 10.

In a case of duplex printing, after the image is printed on one side of the recording sheet, the recording sheet passes through the fixing unit 30 and is transported to a sheet reverse unit 40 disposed outside the image forming apparatus 10. In the sheet reverse unit 40, the sheet transport direction is switched so that an image can be printed on the other side of the recording sheet. The recording sheet is transported to the transfer belt 52 by a duplex transport unit 35 and transport rollers 36 and 25.

The image forming apparatus 10 also includes tension rollers 27 and 28, and a support roller 29. The transfer belt 34 is wound around and stretched by the drive roller 26, the tension rollers 27 and 28, and the support roller 29.

Figure 2:
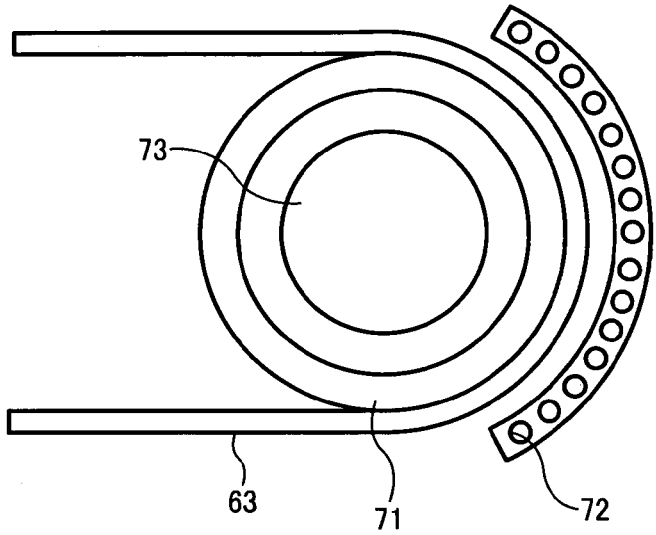
FIG. 2 is a schematic diagram illustrating a heat-width adjuster of a fixing unit employed in the image forming apparatus of FIG. 1 according to the illustrative embodiment of the present invention.
Figure 3:
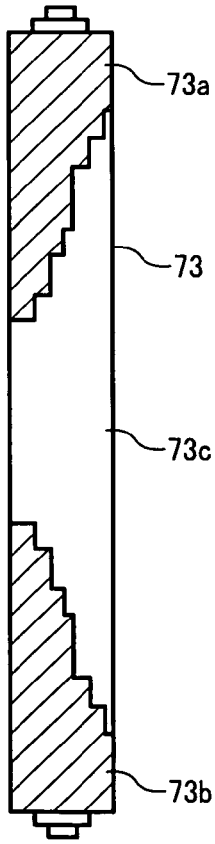
FIG. 3 is a side view illustrating the heat-width adjuster of FIG. 2 according to the illustrative embodiment of the present invention.

Referring now to FIG. 2, there is provided a schematic diagram illustrating a heat-width changing mechanism including a heat-width adjuster 73 using an electromagnetic induction heating method according to the illustrative embodiment of the present invention. FIG. 3 is a side view of the heat-width adjuster 73 of FIG. 2.

The fixing unit 30 of FIG. 1 includes the heat-width changing mechanism including the heat-width adjuster 73 illustrated in FIGS. 2 and 3 to change the heat width of a heating member according to the width of the recording sheet P.

According to the illustrative embodiment, a magnetic field is generated by a coil 72 serving as a heat source, and the heat width of a heating member 71 is regulated using the heat-width adjuster 73. FIG. 2 schematically illustrates the heat-width adjuster 73 according to the illustrative embodiment.

As illustrated in FIG. 3, the heat-width adjuster 73 includes a heating portion 73*c* made of a material such as ferrite and a regulating member 73*a* having a step shape symmetrical to a regulating member 73*b*, and the regulating member 73*b*. The regulating members 73*a* and 73*b* are made of a material such as copper. With this configuration, heating efficiencies thereof are different, thereby regulating the heat width of the heating member 71.

When the heat-width adjuster 73 rotates with the recording sheet P, the heat width of the heating member 71 is regulated, thereby enabling the heat width of the fixing member (fixing belt) 63 to be properly adjusted according to the recording sheet P.

As described above, the coil 72 generates a magnetic field, and the heat-width adjuster 73 including the heating portion 73*c* made of ferrite or the like and the regulating members 73*a* and 73*b* symmetrical to each other regulate the heat width of the heating member 71.

Transport timing of the recording sheet is determined by receiving width information on the recording sheet from a controller 80 serving as a sheet information processor, a detailed description of which is provided later, and based on a first control table 85 and a second control table 82.

With this configuration, there is no need to provide a detector dedicated to detecting a recording sheet P between either the sheet feeder 23 or the separation member 24 and the pair of registration rollers 8. Accordingly, the size of the image forming apparatus as a whole as well as its cost can be reduced.

Figure 4:
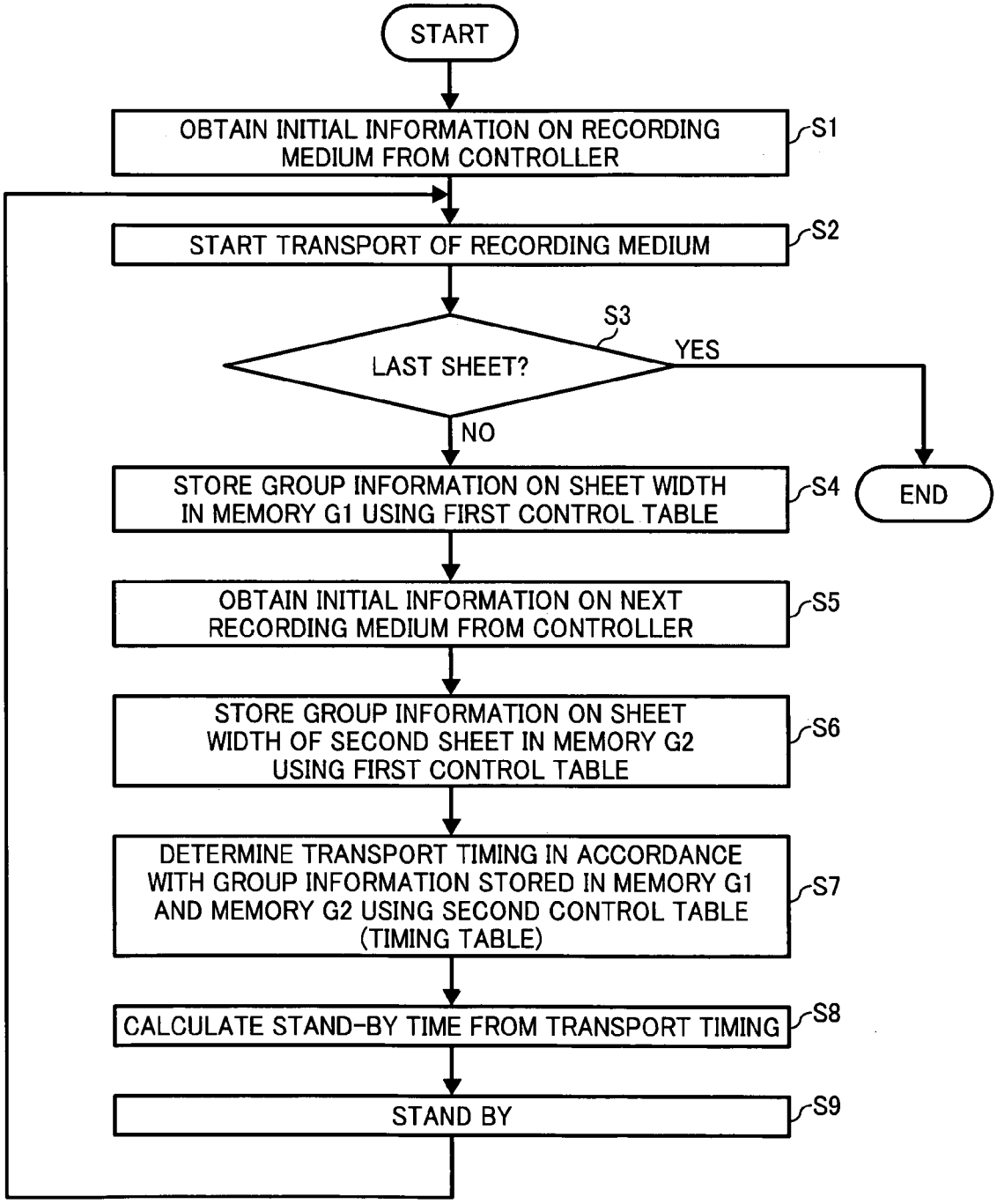
FIG. 4 is a flowchart showing an example of a sheet transport procedure according to the illustrative embodiment of the present invention.
Figures 5, 6:
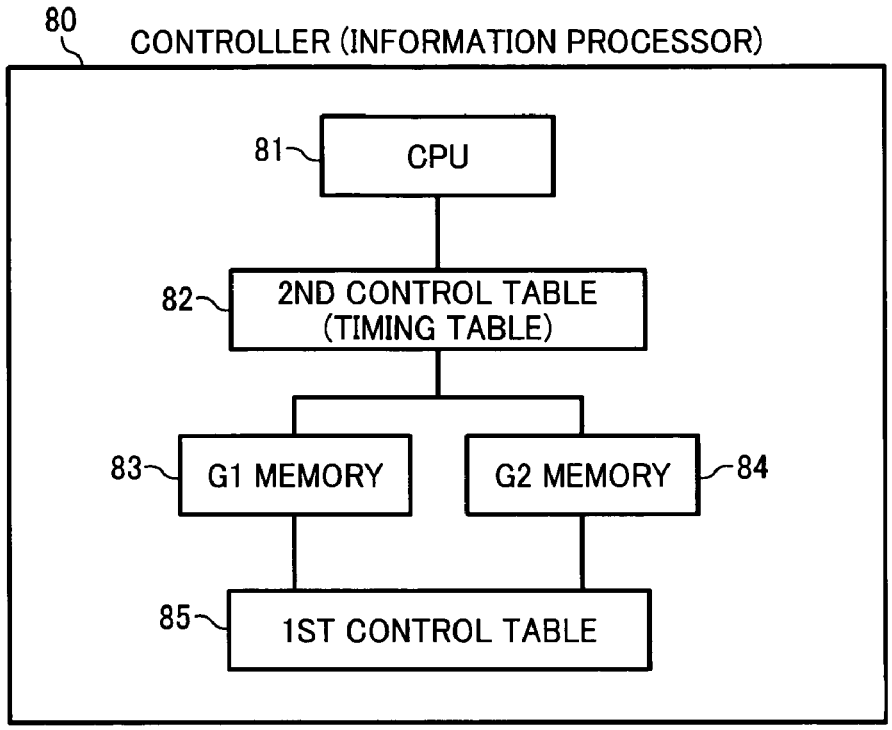
FIG. 5 is a block diagram partially illustrating a controller serving as a sheet information processor in the image forming apparatus according to the illustrative embodiment of the present invention.
FIG. 6 is an example of a second control table according to the illustrative embodiment of the present embodiment.

Referring now to FIG. 4, there is provided a flowchart showing an example procedure of the illustrative embodiment of the present invention. FIG. 5 is a block diagram illustrating the controller 80 serving as the sheet information processor provided to the image forming apparatus 10. FIG. 6 is an example of a timing table serving as the second timing table 82.

Before explaining the flowchart in detail, with reference to FIG. 5, a description is provided of the controller 80 serving as an information processor according to the illustrative embodiment. The controller 80 includes a CPU 81, the first control table 85, the second control table 82 (timing table), a G1 memory 83, and a G2 memory 84.

The CPU 81 of the controller 80 processes information on the recording sheet P, separation control, and determination of the sheet transport timing based on the information from the second control table 82.

The first control table 85 includes initial reference sheet information. According to the illustrative embodiment, the first control table 85 includes information on different standard-sized sheets, based on which the width of the recording sheet is initially categorized.

The G1 memory 83 stores group information including the width information of the first, or the preceding, recording sheet P. The G2 memory 84 stores group information including the width information of the second, or the subsequent, recording sheet P.

When the controller 80 receives print instruction, print data such as character image data, image data, and so forth from a personal computer (PC), the information on the first recording sheet P is referred to the first control table 85 to find an appropriate width group for the first recording sheet. The width group to which the first recording sheet belongs is stored in the G1 memory 83.

The information on the subsequent recording sheet P is referred to the first control table 85, and the width group to which the recording sheet P belongs is stored in the G2 memory 84.

The group information identified by the first control table 85, stored in the G1 memory 83, is compared with the group information identified by the first control table 85, stored in the G2 memory 84, using the second control table 82 serving as a timing table. Accordingly, the CPU 81, which controls sheet transport, fixation, and so forth, determines the sheet transport timing for the subsequent recording sheet P.

With reference to FIG. 1 and FIGS. 4 through 6, a description is provided of an example procedure of determination of the sheet transport timing according to the illustrative embodiment.

In FIG. 4, at S1, information on the first recording sheet P is obtained from the controller 80, and the width of the first sheet is categorized into Group A based on the first control table 85.

According to the illustrative embodiment, the recording sheet P is initially categorized by generally known standard sizes in Group A. Furthermore, the initial group in Group A is divided further into a higher-level group, Group B. In Group B, it is determined whether or not the width of the recording sheet is 200 mm or more.

According to the illustrative embodiment, when the recording sheet P is a standard-sized sheet and the width thereof is 200 mm or more, the recording sheet P is categorized as G1=2 in Group B.

By contrast, when the recording sheet P is a standard-sized sheet and the width thereof is less than 200 mm, the recording sheet P is categorized as G1=1 in Group B.

Then, the sheet information is stored in an internal memory, that is, the G1 memory 83.

In other words, when the preceding recording sheet P is a standard-sized sheet and the width thereof is 200 mm or more, G1=2. The information is stored in the G1 memory 83.

By contrast, when the preceding recording sheet P is a standard-sized sheet and the width thereof is less than 200 mm, G1=1. The information is stored in the G1 memory 83.

After the processing described above, at S2, transport of the preceding or the first recording sheet P is initiated.

Alternatively, sheet transport can be initiated without categorizing the recording sheet. In this case, an interval between transport of the preceding recording sheet and transport of the subsequent recording sheet is set based on the control table. After a predetermined time, transport of the subsequent sheet is initiated.

Furthermore, alternatively, transport timing of the recording sheet may be determined simply by categorizing the recording sheet into Group A, that is, categorizing the recording sheet by generally known standard sizes.

Next, a description is provided of a case in which the recording sheet P is fed from the manual sheet tray 20. Referring back to FIG. 1, the top sheet of the recording sheets on the manual sheet feed tray 20 is separated one sheet at a time by the sheet feeder 23 and is sent to the pair of registration rollers 8 through the pair of the transport rollers 25.

By contrast, when the recording sheet P is fed either from the sheet cassette 21 or the sheet cassette 22, the separation member 24 picks up the top sheet from the sheet cassette 21 or the sheet cassette 22, and sends the recording sheet P to the pair of registration rollers 8 through the pair of transport rollers 25.

Subsequently, at S3, it is determined whether or not the recording sheet being transported is the last sheet. If it is the last sheet, the procedure is finished. By contrast, when it is not the last sheet, the group information on the width of the recording sheet, identified with the first control table 85, is stored in the G1 memory 83 of the controller 80 at S4.

Subsequently, at S5, the information on the second or the subsequent sheet of the recording sheet P is obtained from the controller 80, and the width of the second recording sheet P is categorized by referring to the first control table 85.

Similar to the first sheet, the second or the subsequent recording sheet P is categorized by generally known standard size so as to determine the initial group in Group A. Furthermore, in Group B, it is determined whether or not the width of the recording sheet is 200 mm or more.

When the width of the second or the subsequent sheet is 200 mm or more, the second sheet is categorized as G2=2 in Group B. At S6, the information on the second or the subsequent sheet P is stored in the internal memory, that is, the G2 memory 84.

By contrast, when the width of the second or the subsequent sheet is less than 200 mm, the second sheet is categorized as G2=1 in Group B. At S6, the information on the second sheet is stored in the internal memory, that is, the G2 memory 84.

Subsequently, at S7, in accordance with the second control table 82 serving as a timing table, the values of G1 and G2 obtained from the first control table 85 are compared with each other, and transport timing for the second or the subsequent sheet is determined.

FIG. 6 illustrates one example of the second control table 82.

According to the illustrative embodiment, when $G1 \geqq G2$, the transport timing t is 0.2 seconds (t=0.2 sec.). When $G1<G2$, the transport timing t1 is 4 seconds (t1=4 seconds).

The information on the length of the first recording sheet is obtained from the controller 80 or based on duration of signals from a sheet detector, not illustrated, that detects presence of the recording sheet P. The sheet detector can be provided to the sheet feeder 23 or the separation member 24.

Then, at S8, a stand-by time t2, that is, an interval between the start of transport of the first or the preceding sheet and the start of transport of the second or the subsequent sheet, is calculated by the CPU 81.

For example, when the transport timing t1 is 0.2 seconds (t1=0.2 sec.) and the first sheet of the recording sheet P is a standard A4 sheet fed in landscape orientation, the length of the A4 sheet in the direction of transport is approximately 210 mm.

Landscape orientation herein refers to a horizontal print orientation in which the long side of the sheet is at the top. Thus, when the transport speed of the image forming apparatus in the transport direction is approximately 150 mm/sec, t2 is 1.6 seconds. (t2=0.2+210/150=1.6 seconds)

Subsequently, after transport of the first or the preceding sheet is initiated, the stand-by time t2 is provided at S9. Then, transport of the second or the subsequent sheet is initiated.

Accordingly, when the first and the second recording sheets are categorized into groups based on the sheet widths thereof and then the group G1 of the first recording sheet P is compared with the group G2 of the second recording sheet, the transport timing t1 is determined.

Based on the result, the stand-by time t2 is determined. Only when there is a significant difference between the width of the first or the preceding recording sheet and the width of the second or the subsequent recording sheet, that is, $G1 \neq G2$, the stand-by timing t2 is changed.

By contrast, when the difference between the width of the first or the preceding recording sheet and the width of the second or the subsequent recording sheet is insignificant, that is, G1=G2, t2 can be set to a relatively short time which is substantially the same interval as in the case of continuous printing of the same size recording media sheets P. According to the present embodiment, t2 is set to approximately 0.2 seconds, for example.

With this configuration, the stand-by time t2 is less likely to be longer than the interval for continuous printing. Furthermore, while the present invention is employed and printing in landscape orientation and portrait orientation is properly carried out to correspond to the sheet width so as to reduce fluctuation of the width of the recording sheets, the stand-by time can be reduced.

When the information of the recording sheet including the width information is obtained from the controller 80 and the transport timing is determined based on the first control table 85 and the second control table 82, the sheet detector for detecting the recording sheet P does not have to be provided at the sheet feeder 23 or the separation member 24, or between the pair of the registration rollers 8. Thus, reduction in both size and cost of the image forming apparatus can be achieved.

With reference to FIGS. 1 through 3, a description is provided of another illustrative embodiment of the present invention.

The image forming apparatus of the present embodiment includes the fixing unit 30 equipped with the coil 72 serving as the heat source, the heating member 71, the heat-width adjuster 73 that regulates the heat width of the heating member 71, and an adjuster controller 41 that controls the heat-width adjuster 73.

Upon continuous printing, during the time from which the preceding recording sheet P passes the fixing unit 30 to which the subsequent recording sheet arrives at the fixing unit 30, the adjuster controller 41 controls the heat-width adjuster 73 such that the heat width of the heating member 71 becomes an appropriate width for the subsequent recording sheet.

In other words, in the image forming apparatus 10 of the foregoing embodiment, immediately after or substantially at the same time as the first or the preceding recording sheet passes the fixing unit 30, the heat-width adjuster 73 of the fixing unit 30 is rotated so as to regulate the heat width of the heating member 71 to associate with the width of the second recording sheet.

At this time, when the stand-by time t2 of the second control table 82 is determined to correspond to the time of start and finish of rotation of the heat-width adjuster 73, the heat width corresponding to the width of the recording sheet is attained.

With regard to the stand-by time t2, in a case in which the difference between the width of the first sheet and the width of the second sheet of the recording sheet is insignificant, that is, for example, when the first sheet belongs to 257 of the initial width group A and the second sheet belongs to 210 of the initial width group A, the stand-by time t2 is set at minimum in order to prevent the printing speed from slowing down during continuous printing. For example, according to the present embodiment, t1 is 0.2 seconds (t1=0.2 sec.).

By contrast, in a case in which there is a significant difference between the width of the first sheet and the width of the second sheet of the recording sheet, problems such as significant rise in temperatures or insufficient heat in the vicinity of the end portions of the heat source 72, the heating member (the auxiliary fixing member) 71, the fixing belt 63, and so forth occurs. For this reason, it is necessary to properly adjust the heat-width adjuster 73 to correspond to the width of the recording sheet before the subsequent recording sheet arrives at the fixing device 30.

When the difference between the width of the first sheet and the width of the second sheet of the recording sheet is insignificant, even if adjustment of the heat-width adjuster 73 is not completed at the time of arrival of the subsequent recording sheet at the fixing unit 30, the heating area that exceeds the width of the recording sheet is relatively small. Thus, the significant rise in temperatures or insufficient heat in the vicinity of the end portions of the heat source 72, the heating member (the auxiliary fixing member) 71, the fixing belt 63, and so forth does not cause a serious problem.

In this regard, when grouping of the first control table 85 is determined in accordance with output of the heat source 72, sheet transport speed, a heat capacity of the fixing belt 63 and the auxiliary fixing member, the stand-by time t2 can be prevented from exceeding the interval for continuous printing of the same-size recording media sheets without significant rise in temperatures or insufficient heat in the vicinity of the end portions of the heat source 72, the heating member (the auxiliary fixing member) 71, the fixing belt 63, and so forth.

A description is now provided of another illustrative embodiment (Embodiment 3).

Referring now to FIG. 7, there is provided a table for showing classification of the width of the recording sheet. FIG. 8 is a table serving as the second control table 82.

According to Embodiment 3, information on the width and the type of recording sheet are obtained from the controller 80, and the table as shown in FIG. 8 is employed as the second control table 82.

The timing of transport of the recording sheet is determined based on the first control table 85 and the second control table 82, using the information on the width of the recording sheet in the direction perpendicular to the sheet transport direction and the type of recording sheet obtained from the controller 80 illustrated in FIG. 5.

According to the present embodiment, in addition to the width information of the recording sheet, the information on the type of recording sheet is obtained from the controller 80, and the transport timing of the recording sheet is determined based on the first control table 85 and the second control table 82.

When the information on the type of recording sheet as well as the information on the width thereof is obtained from the controller 80 and the sheet transport timing t1 and the stand-by time t2 are determined based on the second control table 85, the time required for changing the setting of the image forming apparatus can be secured even if the type of recording sheets varies. When the transport timing for the recording sheet is properly set, the printing speed can be prevented from slowing down during the continuous printing.

A description is now provided of another illustrative embodiment (Embodiment 4).

With reference to FIGS. 7 and 8, a description is provided of continuous printing of a normal sheet and then a relatively thick sheet, according to the present embodiment.

When continuously printing out the first or the preceding recording sheet of a normal A4 sheet fed in landscape orientation and the second or the subsequent recording sheet of a relatively thick A5 sheet fed in portrait orientation, the first sheet is categorized as G1=2 for the width of 200 mm or greater, and the second sheet is categorized as G2=1 for the width less than 200 mm. Thus, G1 is greater than G2 (G1>G2), and the sheet transport timing t1 is 6 seconds (t1=6 seconds).

In accordance with this sheet transport timing, the stand-by time t2, that is, the time from the start of transport of the first sheet to the start of transport of the second sheet, is calculated.

According to the present embodiment, the image forming apparatus includes the fixing unit 30 equipped with the heat source 72, the heating member 71, the heat-width adjuster 73 that regulates the heat width of the heating member 71, and the adjuster controller 41 that controls the heat-width adjuster 73 and the heat source 72.

Upon continuous operation, during the time from when the preceding recording sheet passes the fixing unit 30 to when the subsequent recording sheet arrives at the fixing unit 30, the adjuster controller 41 controls the heat-width adjuster 73 and the heat source 72 such that the heat-width adjuster 73 is regulated to the proper heat width for the subsequent recording sheet, and the heat source 72 is regulated according to the type of recording sheet.

Immediately after or substantially at the same time as the first recording sheet passes the fixing unit 30, the adjuster controller 41 causes the heat-width adjuster 73 of the fixing unit 30 to rotate so that the heat width is regulated to the proper heat width for the second recording sheet. Furthermore, the adjuster controller 41 controls the heat source 72 to a proper temperature for the type of second recording sheet.

According to the present embodiment, because more heat is needed for the thick sheet than for the normal sheet, in a case in which the first sheet is a normal sheet and the second sheet is a thick sheet, the sheet transport timing t1 is set relatively long so that the fixing belt 63 and the heating member or the auxiliary fixing member 71 can accumulate heat.

As described above, when the type of recording sheet varies, the amount of heat necessary for fixation differs as well. Thus, it is necessary to change the amount of heat accumulated by the fixing belt 63 and the heating member (the auxiliary fixing member) 71 by changing the output and/or duty cycle of the heat source 72.

In view of this, when the time required for changing the output and/or duty cycle of the heat source 72 is incorporated in the sheet transport timing t1 and the stand-by timing t2 of the second control table 85 of FIG. 5 in advance, significant rises in temperature or insufficient heat in the vicinity of the end portions of the heat source 72, the heating member (the auxiliary fixing member) 71, the fixing member 63, and so forth can be prevented, and further, deterioration of performance during continuous printing can be prevented.

Figure 9:
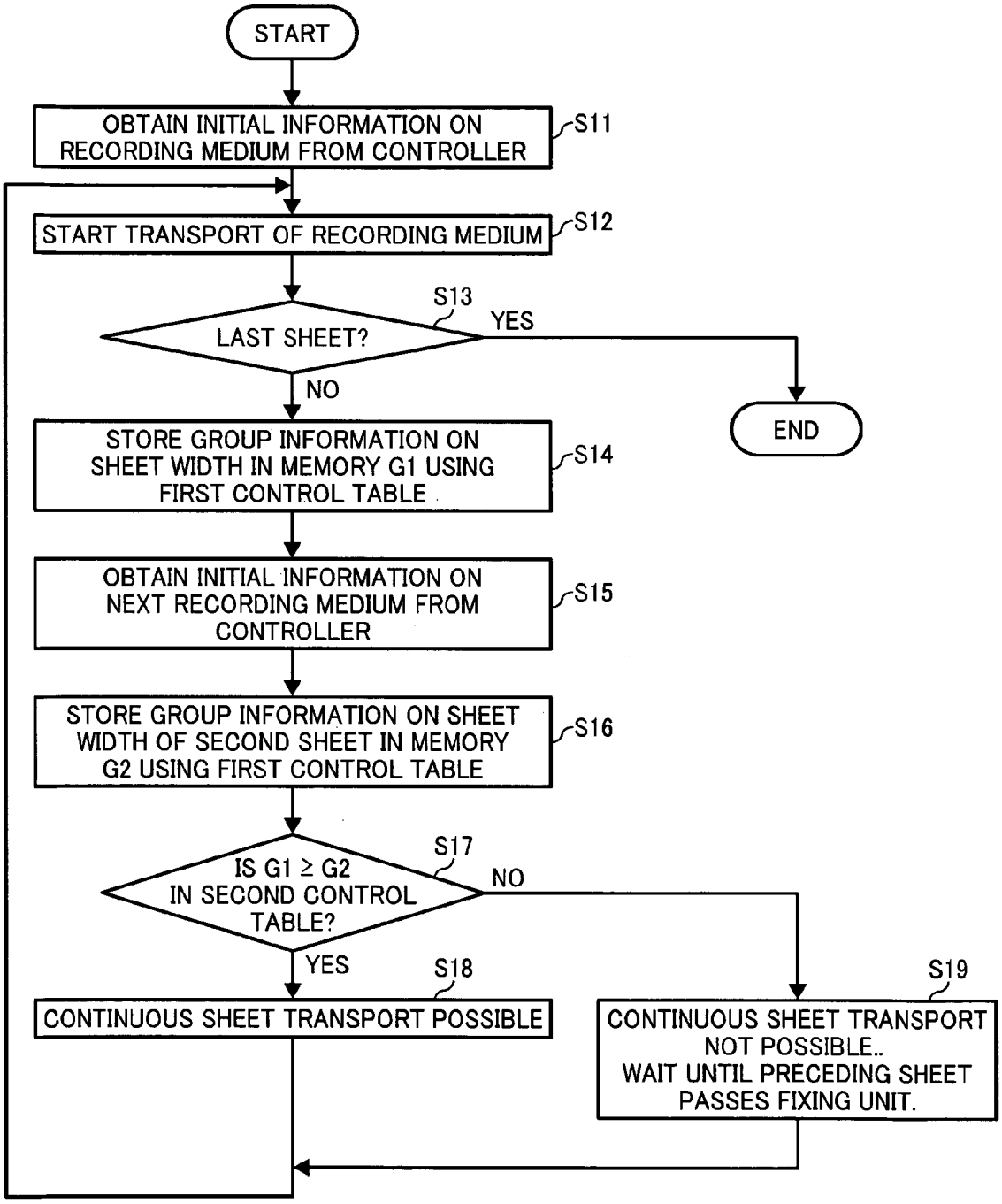
FIG. 9 is a flowchart showing an example of a sheet transport procedure according to another illustrative embodiment of the present invention.

With reference to FIG. 9, a description is provided of another illustrative embodiment (Embodiment 5). FIG. 9 is a flowchart showing an example procedure of the present embodiment.

At S1, information on the first or the preceding sheet of the recording sheet is obtained from the controller 80, and the width information of the first sheet is referred to the first control table 85 so as to categorize the width of first sheet in Group A.

After the procedure shown in the flowchart of FIG. 4 is performed, at S12, transport of the first sheet is initiated. In a case of manually feeding the first sheet, the top sheet of the recording sheets on the manual sheet feed tray 20 is transported to the pair of the registration rollers 8 by the sheet feeder 23.

In a case of feeding the first sheet from the sheet cassette 21 or the sheet cassette 22, the separation member 24 picks up the top sheet and sends it to the registration rollers 8 through the pair of the transport rollers 25.

Subsequently, at S13, whether or not the sheet being transported is the last sheet is determined. When it is the last sheet, the procedure is finished. By contrast, when it is not the last sheet, at S14, based on the first control table 85, the group information of the width of the first sheet is stored in the G1 memory 83 of the controller 80.

Subsequently, at S15, information on the second sheet is obtained from the controller 80 and referred to the first control table 85 so as to categorize the width of the second sheet in Group A.

Similar to the first sheet, the second sheet is categorized by generally known standard sizes, and the initial group, to which the second sheet belongs, is determined in Group A. Furthermore, when the width of the second sheet in Group A is 200 mm or greater, G2 is 2 (G2=2) in Group B. By contrast, when the second sheet is less than 200 mm, G2 is 1 (G2=1) in Group B. Subsequently, at S16, the group information of the width of the second sheet is stored in the G2 memory 84.

Subsequently, at S17, using the second control table 82 serving as the timing table, the results of G1 and G2 obtained from the first control table 85 are compared, and whether or not G1 is equal to or greater than G2 is determined (G1≧G2).

When G1≧G2, it is determined at S18 that continuous transport is possible, and the procedure returns to S12 and execute the procedure assuming t=0.2 seconds, for example.

Referring now to FIG. 10, there is provided an example of a timing table serving as the second control table 82.

When G1 is not equal to or greater than G2 at S17, that is, G1 is less than G2 (G1<G2), it is determined that continuous sheet transport cannot be performed at S19, and transport of the second sheet is initiated after the first sheet passes the fixing unit 30.

As described above, when G1 is equal to or greater than G2 (G1≧G2), it is determined that continuous sheet transport can be carried out. Since the width of the first sheet is relatively wide and the width of the subsequent sheet is less than that of the first sheet, and further, the difference between the widths of the first and the second sheets is relatively small, the amount of heat in the area outside the end portions of the sheet becomes temporarily excessive when the portion of the subsequent sheet in the vicinity of the leading end thereof is being fixed.

However, after the heat-width adjuster 73 illustrated in FIG. 2 is regulated such that the heat width corresponds to the width of the recording sheet, the area outside the recording sheet is prevented from being heated, thereby reducing temperatures thereat.

Accordingly, significant rises in temperature and/or insufficient heat can be prevented without extending the sheet transport timing t1 and the stand-by time t2 more than necessary.

In this case, the detector that detects presence of the recording sheet may be provided immediately after the fixing unit 30. Alternatively, as shown in the table of FIG. 10, the transport timing for the second sheet can be set in advance so that the detector dedicated for detecting presence of the recording sheet is not necessary.

With reference to FIG. 11, a description is now provided of another embodiment (Embodiment 6). Referring now to FIG. 11, there is provided a table for showing an example of the control table serving as the first control table 85.

According to the present embodiment, when the recording sheet is categorized by referring to the first control table 85, an arbitrary width of the recording sheet in the initial Group A in the first control table 85 belongs to a plurality of groups in Group B. For example, a group 210 of the group A belongs to both G=1 and G=2 in Group B When the first sheet is categorized into a group 257 in Group A, G1 is 2 (G1=2). When the second sheet is categorized into the group 210 in Group A, the group 210 belongs to both G=1 and G=2, and the same group as that of the preceding recording sheet is prioritized and selected. As a result, G2 is G1 (G2=G1), thus achieving t1=0.2 seconds.

As can be understood, when the frequently-used width group in Group A is shared by Group B, risk of degradation of continuous printing can be effectively reduced.

For example, in a case in which a plurality of sheets of different sizes are continuously printed out in the following order, for example, the first sheet is an A5 sheet and fed in landscape orientation, the second sheet is an A6 sheet and fed in portrait orientation, the third sheet is an A5 sheet and fed in landscape orientation, and the fourth sheet is an A4 sheet and fed in landscape orientation, and when the table as shown in FIG. 7 is used as the first control table 85 while the table as shown in FIG. 10 is used as the second control table 82, the sheet transport timing for the second and the third sheets is t1=4 seconds, which is relatively long.

However, when the table as shown in FIG. 11 is employed for the first control table 85, the sheet transport timing for all the sheets becomes 0.2 seconds without undesirably extending the transport timing t1 and the stand-by time t2. Furthermore, significant rise in the temperature or insufficient heat at the end portions of the heating member, the fixing member, and so forth can be prevented.

According to the illustrative embodiment, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus for forming an image, comprising:

an image bearing member to bear an electrostatic latent image on a surface thereof;

a developing device to develop the electrostatic latent image formed on the image bearing member using toner to form a toner image;

a transfer device to transfer the toner image onto a recording sheet;

a fixing device to fix the toner image;

a sheet feeder to feed the recording sheet;

a first control table containing information on widths of the recording sheet categorized into a plurality of groups of different widths thereof in a direction perpendicular to a sheet transport direction; and a second control table containing information on transport timing of the recording sheet to the fixing device based on the group to which a preceding recording sheet belongs and the group to which a subsequent recording sheet belongs, wherein, when a certain width of the recording sheet belongs to the plurality of groups in the first control table, the group to which the preceding recording sheet belongs is the group to which the subsequent recording sheet belongs.

2. The image forming apparatus according to claim 1, further comprising:

an information processor including a CPU, to receive and process information on a print instruction and information on the recording sheet including the width and type thereof, wherein the width information of the recording sheet obtained from the information processor is referred to the first control table so as to determine the group to which the recording sheet belongs.

3. The image forming apparatus according to claim 2, wherein the second control table further includes information on transport timing of the recording sheet to the fixing device based on the type of recording sheet, and the transport timing of the recording sheet is determined based on the information on the type of recording sheet obtained from the information processor.

4. The image forming apparatus according to claim 1, wherein the fixing device includes:

a heating member;

a heat source for the heating member;

a heat-width adjuster to regulate a heat width of the heating member; and an adjuster controller to control the heat-width adjuster, wherein, upon continuous printing, during a time from when the preceding recording sheet passes the fixing device to when the subsequent recording sheet arrives at the fixing device, the adjuster controller controls the heat-width adjuster such that the heating member has an appropriate heat width for the subsequent recording sheet.

5. The image forming apparatus according to claim 1, wherein the fixing device includes a heating member;

a heat source for the heating member;

a heat-width adjuster to regulate a heat width of the heating member; and an adjuster controller to control the heat-width adjuster, wherein, upon continuous printing, during a time from when the preceding recording sheet passes the fixing device to when the subsequent recording sheet arrives at the fixing device, the adjuster controller controls the heat-width adjuster such that the heating member has an appropriate heat width for the subsequent recording sheet, and the adjuster controller also controls the heat source according to a type of the recording sheet.

* * * * *